US011503900B2

(12) United States Patent
Chen

(10) Patent No.: US 11,503,900 B2
(45) Date of Patent: Nov. 22, 2022

(54) MIST SPRAYING HAIR BRUSH WITH RETRACTABLE BRISTLES

(71) Applicant: Zhongshan Yingliang Health Technology Co., Ltd, Zhongshan (CN)

(72) Inventor: Yi-Tzu Chen, Taoyuan (TW)

(73) Assignee: Zhongshan Yingliang Health Technology Co., Ltd., Zhongshan (CN)

( * ) Notice: Subject to any disclaimer, the term of this patent is extended or adjusted under 35 U.S.C. 154(b) by 360 days.

(21) Appl. No.: 16/823,188

(22) Filed: Mar. 18, 2020

(65) Prior Publication Data

US 2021/0161285 A1 Jun. 3, 2021

(30) Foreign Application Priority Data

Dec. 3, 2019 (TW) ..... 108216106

(51) Int. Cl.

| | |
|---|---|
| ***A46B 11/00*** | (2006.01) |
| ***B65D 83/28*** | (2006.01) |
| ***A46B 15/00*** | (2006.01) |
| ***A46B 7/02*** | (2006.01) |
| ***A46B 9/02*** | (2006.01) |

(52) U.S. Cl.

CPC ..... *A46B 11/0017* (2013.01); *A46B 7/023* (2013.01); *A46B 9/023* (2013.01); *A46B 15/0022* (2013.01); *B65D 83/285* (2013.01)

(58) Field of Classification Search

CPC ... A46B 11/0017; A46B 11/062; A46B 9/023; A46B 7/023; B65D 83/285

See application file for complete search history.

(56) References Cited

U.S. PATENT DOCUMENTS

| | | | |
|---|---|---|---|
| 1,388,955 | A | 8/1921 | Kozlowsky et al. |
| 4,527,576 | A | 7/1985 | Chou |
| 7,237,277 | B1 | 7/2007 | Tsai |

FOREIGN PATENT DOCUMENTS

| | | | |
|---|---|---|---|
| FR | 2661811 | A3 | 11/1991 |
| JP | H07116029 | A * | 5/1995 |
| WO | 2009065747 | A1 | 5/2009 |

* cited by examiner

*Primary Examiner* — Shay Karls

(74) *Attorney, Agent, or Firm* — Snell & Wilmer L.L.P.

(57) ABSTRACT

A mist spraying hair brush with retractable bristles includes a brush body, an actuating shaft, a mist spraying assembly, and a housing containing these components. The actuating shaft has a bended portion. When the actuating shaft is rotated and the bended portion pushes the brush body, multiple bristles of the brush body extend out of the housing. The mist spraying assembly has an electric oscillation assembly and an injection portion. The injection portion communicates with the oscillation assembly, such that liquid flows to the oscillation assembly via the injection portion and is atomized into spray. Then the spray flows out of the housing. The mist spraying hair brush with retractable bristles is small in size and is convenient in storage. Moreover, the multiple bristles can retract into the housing, so the multiple bristles will not be bended when carried in a bag full of objects.

12 Claims, 7 Drawing Sheets

MIST SPRAYING HAIR BRUSH WITH RETRACTABLE BRISTLES

BACKGROUND OF THE INVENTION

Field of the Invention

The present invention relates to a hair brush, and more particularly to a mist spraying hair brush with retractable bristles.

Description of Related Art

A conventional hair brush can only be used to brush hair. With reference to FIG. 7, to make the process of hair styling more convenient, a conventional water jet hair brush 80 is provided. The conventional water jet hair brush 80 includes a body 81, a trigger sprayer 82, and a bottle 83. The body 81 has multiple bristles 811 and multiple spouts 812 disposed thereon. The multiple bristles 811 and the multiple spouts 812 are disposed at spaced intervals. Liquid is ejected from the multiple spouts 812 toward an extension direction of the multiple bristles 811. The trigger sprayer 82 is mounted to the body 81 and has a sucker 821 and a trigger 822. The sucker 821 extends toward a direction away from the body 81. The trigger 822 is disposed on the trigger sprayer 82 and is adjacent to the body 81. The bottle 83 is utilized to contain liquid or fluid such as water, hair conditioner, and essential oil. The bottle 83 is mounted to the trigger sprayer 82, and the sucker 821 of the trigger sprayer 82 extends into the bottle 83.

In use, press the trigger 822, and then the liquid is sucked to the body 81 via the sucker 821. Next, the liquid will be pressurized by the trigger sprayer 82 and be ejected from the multiple spouts 812 to a user's hair. Overall, the user can use the conventional water jet hair brush 80 to brush hair and to spray liquid on his/her hair.

However, in use, the user has to press the trigger 822 continuously to keep the liquid ejected from the multiple spouts 812. At the same time, the user has to hold the bottle 83 of a big size, which causes muscle soreness of the user's hand. In addition to that, if the conventional water jet hair brush 80 is carried in a bag full of objects, the multiple bristles 811 may bend or break when squeezed or hit by the objects. Furthermore, the trigger sprayer 82 and the bottle 83 are big in size, which makes the conventional water jet hair brush 80 inconvenient in storage.

To overcome the shortcomings of the water jet hair brush 80, the present invention tends to provide a mist spraying hair brush with retractable bristles to mitigate or obviate the aforementioned problems.

SUMMARY OF THE INVENTION

The main objective of the present invention is to provide a mist spraying hair brush with retractable bristles.

The mist spraying hair brush with retractable bristles includes a housing, a brush body, at least one restoring spring, an actuating shaft, and a mist spraying assembly. The housing has a containing space, multiple through holes, and a mounting hole. The containing space is defined in the housing. The multiple through holes are disposed through a side of the housing, are disposed at spaced intervals, and communicate with the containing space of the housing. The mounting hole is disposed through the side of the housing that the multiple through holes are disposed through, is spaced apart from the multiple through holes, and communicates with the containing space of the housing.

The brush body is disposed in the containing space of the housing, moves linearly in the containing space, and has a base and multiple bristles. The multiple bristles are disposed at spaced intervals on a side surface of the base, and each one of the multiple bristles is capable of extending out of a respective one of the multiple through holes. The at least one restoring spring is mounted between the housing and the base of the brush body. The actuating shaft is rotatably mounted to the housing, is disposed in the containing space, and has a bended portion formed radially between two ends of the actuating shaft. The mist spraying assembly is disposed in the containing space of the housing, and has an oscillation assembly and an injection portion. The oscillation assembly is mounted in the mounting hole of the housing. The injection portion is disposed in the containing space of the housing, and communicates with the oscillation assembly, such that liquid flowing from the injection portion to the oscillation assembly is atomized into spray when the oscillation assembly is oscillating, and then the spray flows out of the housing via the mounting hole.

When the actuating shaft is rotated and the bended portion pushes the base of the brush body, the brush body moves linearly and each one of the multiple bristles extends out of the corresponding through hole.

Elastic potential energy is stored in the at least one restoring spring when the bended portion pushes the base of the brush body. When the bended portion leaves the base, the elastic potential energy is released to make the at least one restoring spring bounce to make the multiple bristles retract into the housing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
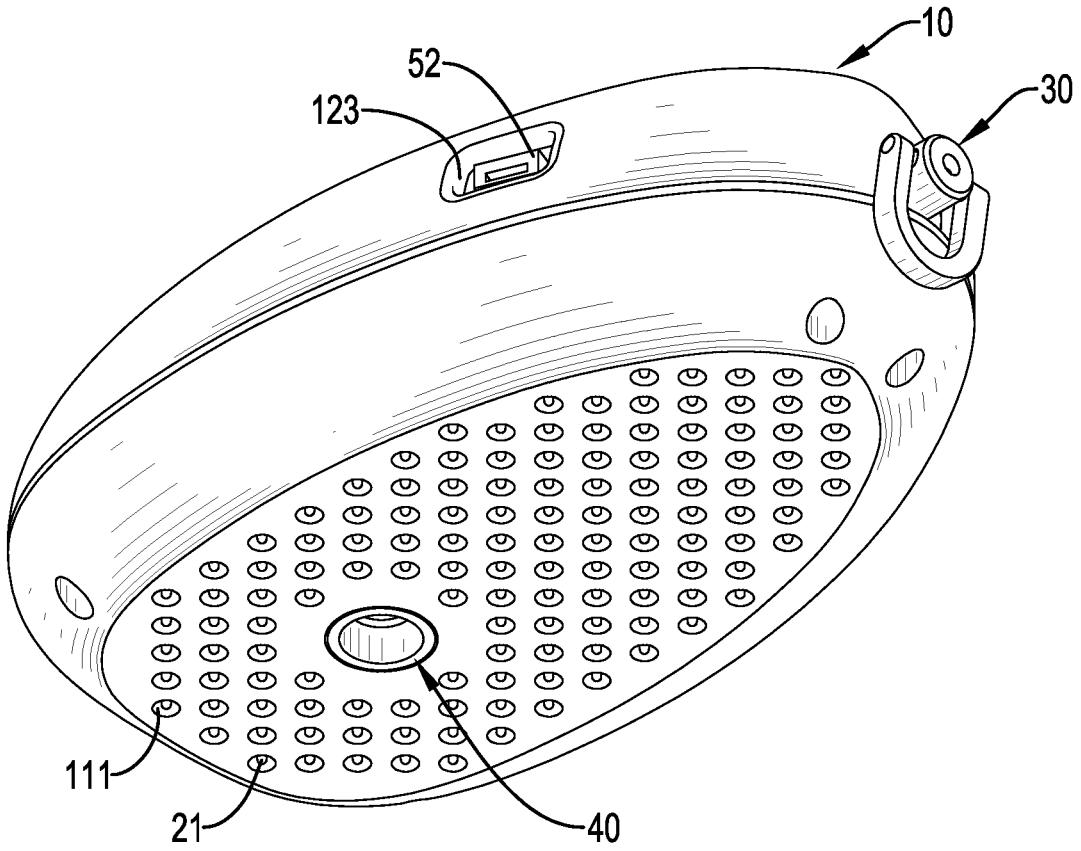
FIG. 1 is a perspective view of a mist spraying hair brush with retractable bristles in accordance with the present invention.
Figure 2:
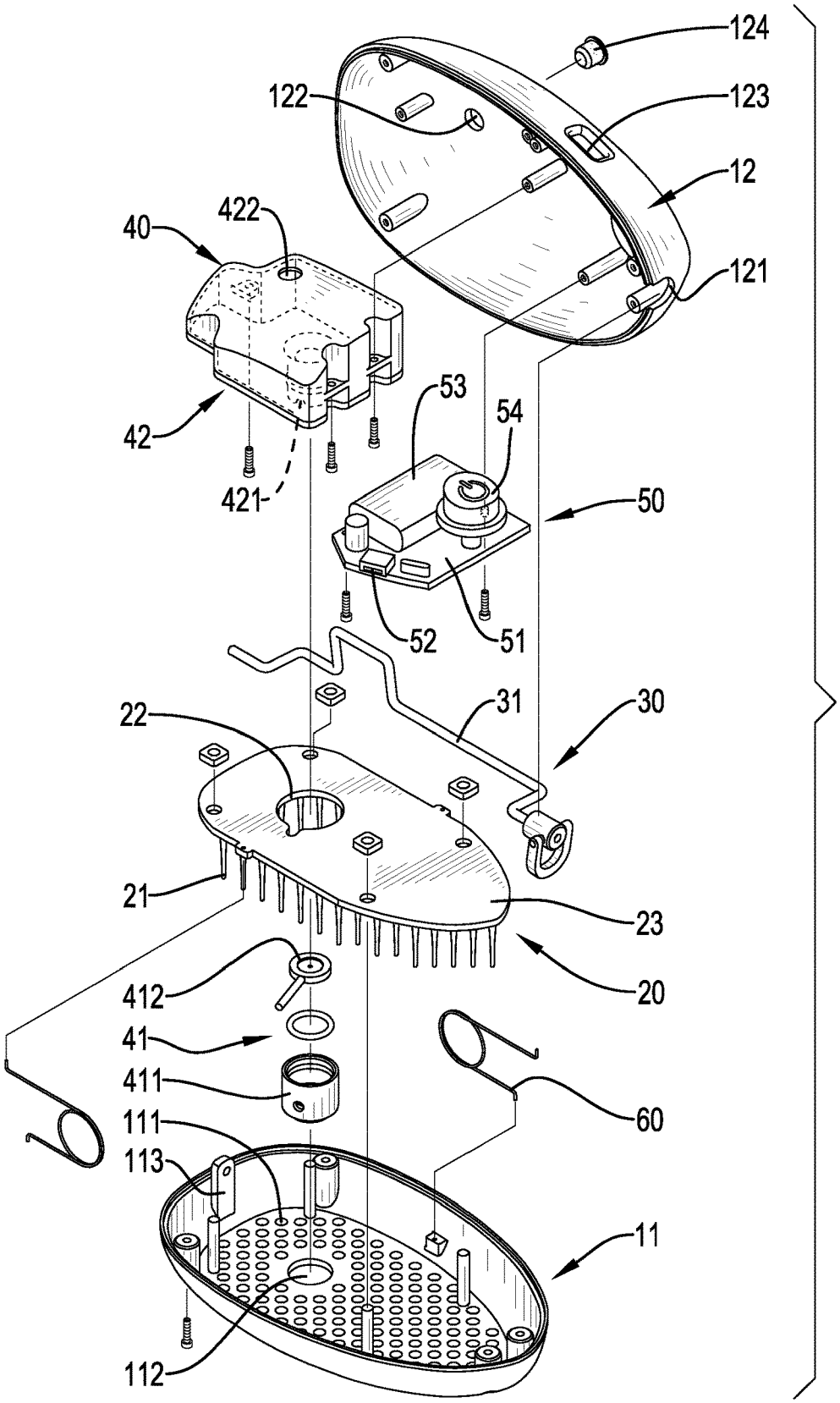
FIG. 2 is an exploded perspective view of the mist spraying hair brush with retractable bristles in FIG. 1.
Figure 3:
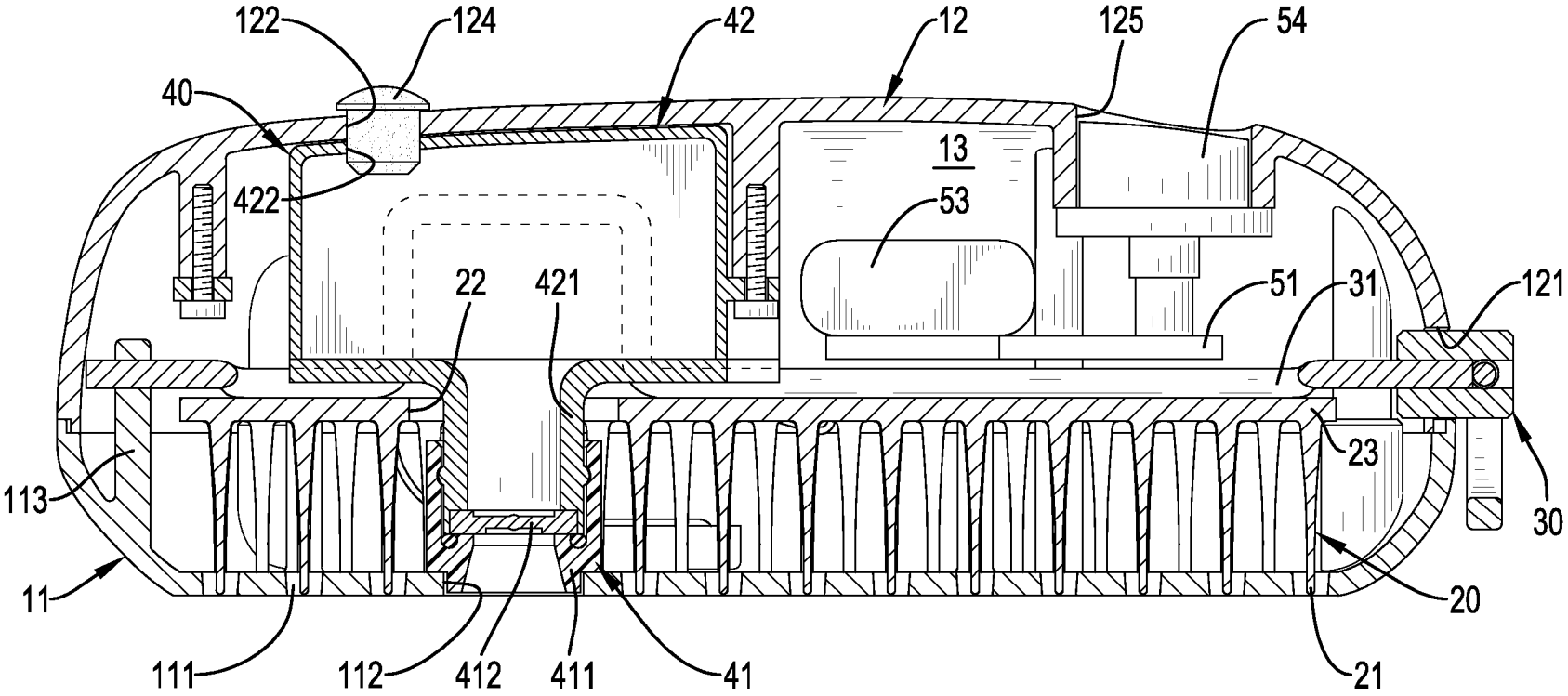
FIG. 3 is a cross-sectional side view in partial section of the mist spraying hair brush with retractable bristles in FIG. 1.

With reference to FIGS. 1 to 3, a mist spraying hair brush with retractable bristles in accordance with the present invention includes a housing 10, a brush body 20, an actuating shaft 30, a mist spraying assembly 40, and an electric control unit 50.

With reference to FIGS. 1 to 3, the housing 10 has a first casing 11 and a second casing 12. The first casing 11 and the second casing 12 are assembled to form the housing 10 and to define a containing space 13 in the housing 10. The first casing 11 has multiple through holes 111, a mounting hole 112, and a pivotal segment 113. Each one of the multiple through holes 111 is disposed through a bottom of the first casing 11, and the multiple through holes 111 are disposed at spaced intervals. The mounting hole 112 is disposed through the bottom of the first casing 11, and the mounting hole 112 is spaced apart from the multiple through holes 111. The multiple through holes 111 and the mounting hole 112 communicate with the containing space 13. In the present invention, the multiple through holes 111 surround the mounting hole 112. The pivotal segment 113 is disposed on an inner wall of the first casing 11, is disposed adjacent to an edge of the first casing 11, and extends toward the second casing 12.

The second casing 12 has a notch 121, an injection hole 122, an opening 123, a plug 124, and a receiving hole 125. The notch 121 is caved upwardly on an edge of the second casing 12 and is aligned with the pivotal segment 113. When the first casing 11 and the second casing 12 are combined together, the notch 121 of the second casing 12 is aligned with the pivotal segment 113 of the first casing 11, and the notch 121 and the pivotal segment 113 are disposed at a front side and a rear side of the housing 10, respectively. The injection hole 122 is disposed through the second casing 12. The opening 123 is disposed through the second casing 12 and is spaced apart from the injection hole 122. The injection hole 122 and the opening 123 both communicate with the containing space 13. The plug 124 is detachably inserted in the injection hole 122, and the plug 124 corresponds in contour to the injection hole 122. The receiving hole 125 is formed through the second casing 12, and the receiving hole 125 communicates with the containing space 13.

With reference to FIGS. 1 to 3, the brush body 20 is disposed in the containing space 13 of the housing 10 and moves linearly between the first casing 11 and the second casing 12. The brush body 20 has a base 23, multiple bristles 21, and a passing hole 22. The base 23 is contained in the containing space 13 of the housing 10 and is disposed between the first casing 11 and the second casing 12. The multiple bristles 21 are disposed at spaced intervals on a side surface of the base 23 facing the first casing 11, and each one of the multiple bristles 21 protrudes toward a respective one of the multiple through holes 111 of the first casing 11, such that each one of the multiple bristles 21 extends out of the corresponding through hole 111 when the base 23 moves toward the first casing 11. The passing hole 22 is formed through the base 23 and the passing hole 22 is aligned with the mounting hole 112 of the first casing 11, such that the multiple bristles 21 surround the passing hole 22.

Figure 4:
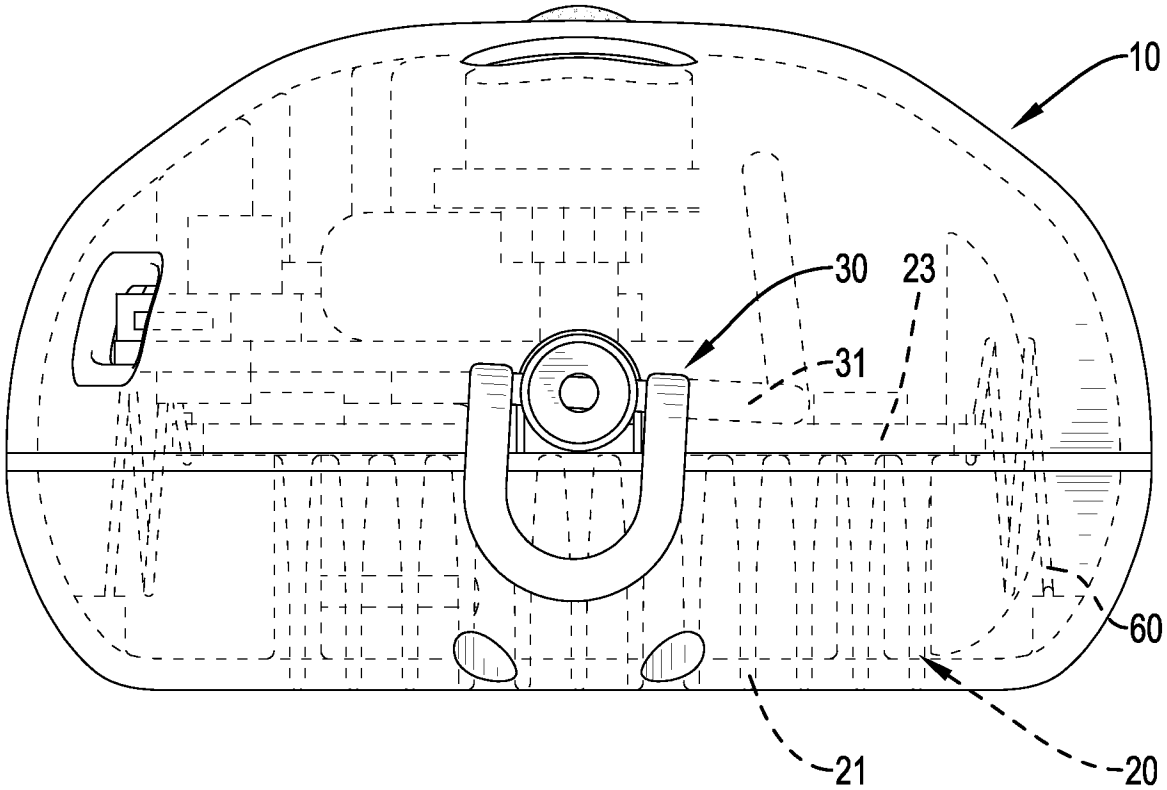
FIG. 4 is a front side view of the mist spraying hair brush with retractable bristles in FIG. 1.
Figure 5:
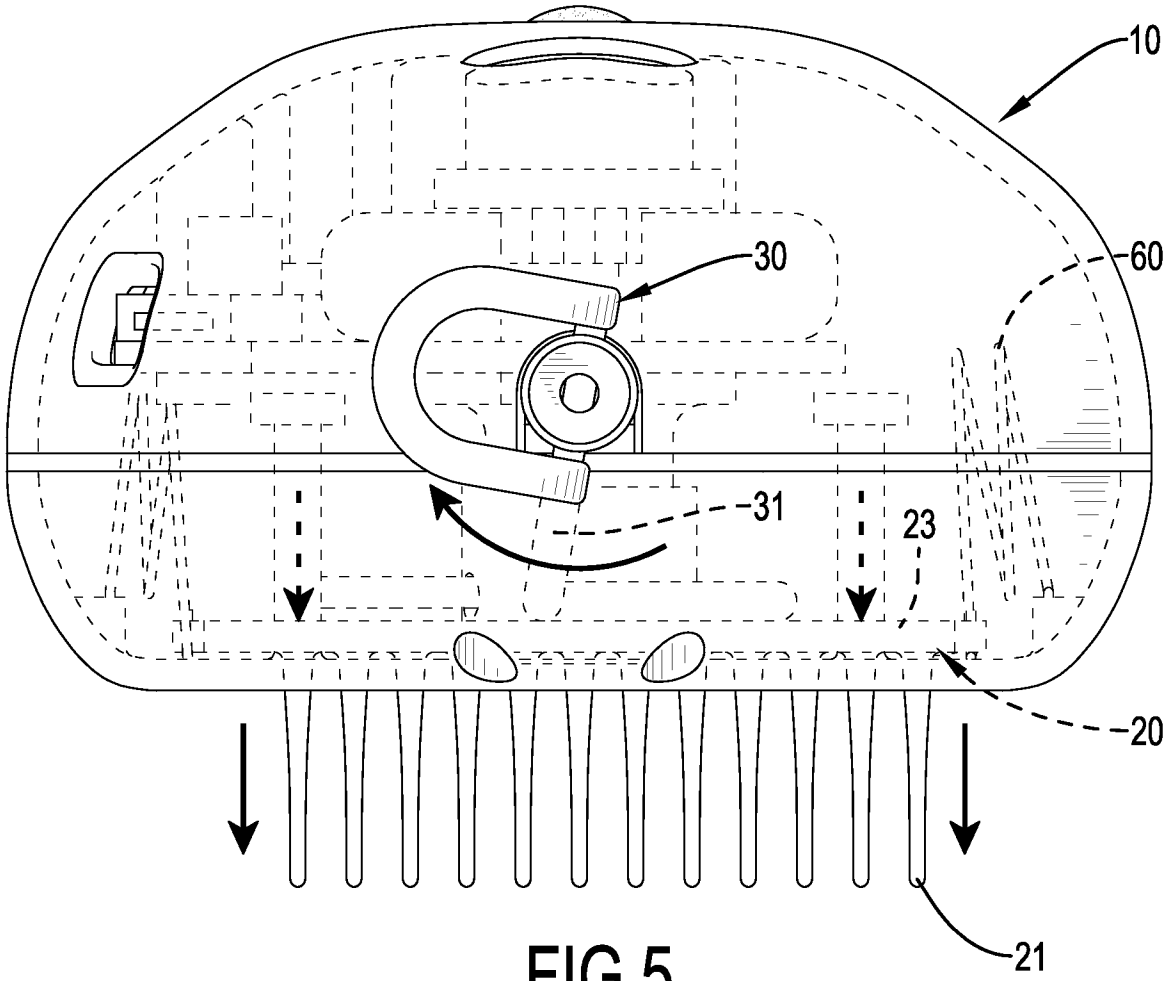
FIG. 5 is an operational front side view of the mist spraying hair brush with retractable bristles in FIG. 4.
Figure 6:
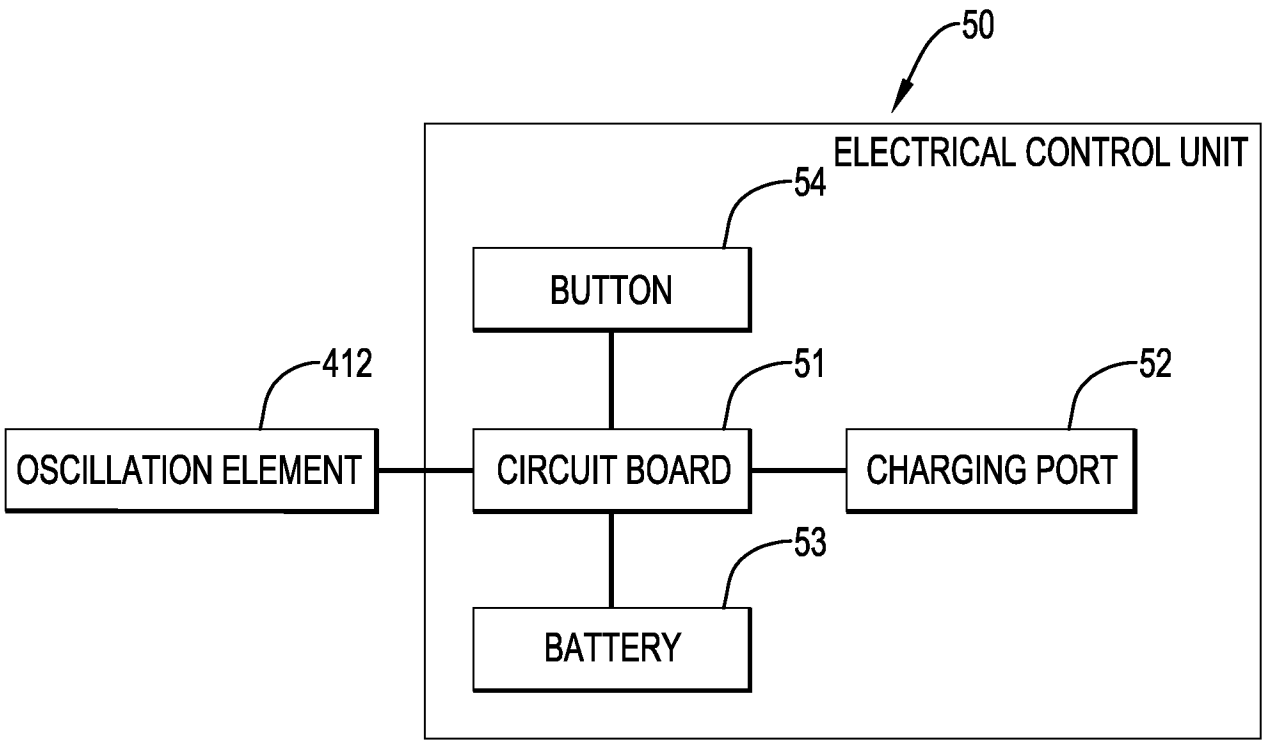
FIG. 6 is a circuit block diagram of an oscillation assembly and an electric control unit of the mist spraying hair brush with retractable bristles in FIG. 1.
Figures 7, 7A:
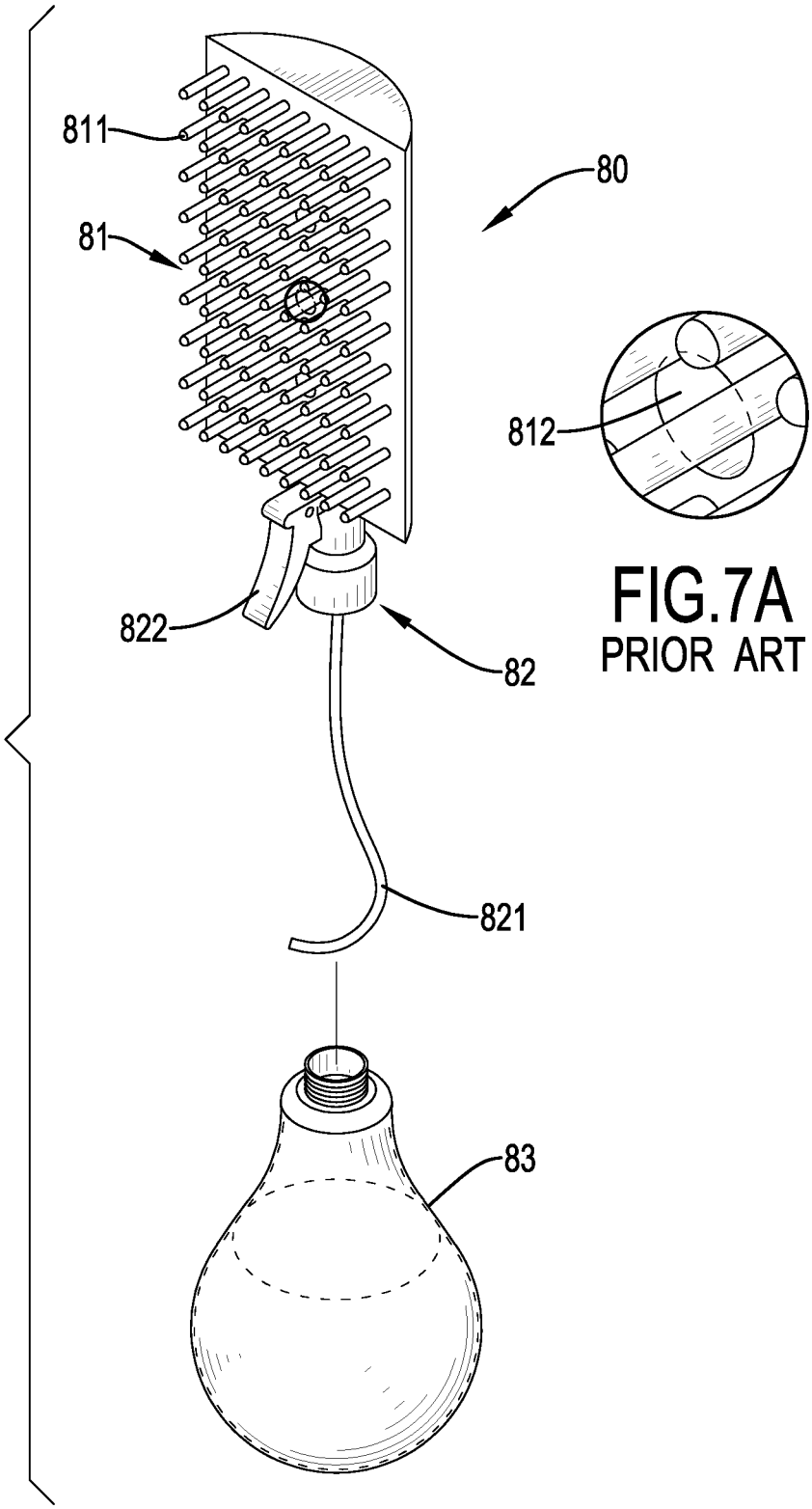
FIG.7A PRIOR ART
FIG.7 PRIOR ART
FIG. 7 is an exploded perspective view of a water jet hair brush in accordance with the prior art.
FIG. 7A is an enlarged perspective view of a spout of the water jet hair brush in accordance with the prior art.

With reference to FIGS. 2 to 5, the actuating shaft 30 is rotatably mounted to the housing 10, is above the brush body 20, and the actuating shaft 30 has two ends and a bended portion 31. One of the two ends of the actuating shaft 30 extends into the containing space 13 and is rotatably mounted to the pivotal segment 113 of the first casing 11. The other one of the two ends of the actuating shaft 30 extends out of the housing 10 via the notch 121 of the second casing 12. The bended portion 31 is radially bended between the two ends of the actuating shaft 30. With reference to FIGS. 4 and 5, when the actuating shaft 30 is rotated and the bended portion 31 in turn pushes the base 23 of the brush body 20, the brush body 20 gradually moves linearly toward the first casing 11 and each one of the multiple bristles 21 gradually extends out of the corresponding through hole 111. Then a user can brush his/her hair with the present invention.

Furthermore, the mist spraying hair brush with retractable bristles includes at least one restoring spring 60 mounted between the first casing 11 and the base 23 of the brush body 20. In the present invention, the mist spraying hair brush with retractable bristles includes two restoring springs 60. When the actuating shaft 30 pushes the base 23 of the brush body 20, elastic potential energy is stored in the two restoring springs 60. After finishing brushing hair with the present invention, rotate the actuating shaft 30 in a reverse direction and the bended portion 31 of the actuating shaft 30 leaves the base 23 of the brush body 20. Then the elastic potential energy stored in the two restoring springs 60 is released and the two restoring springs 60 bounce to push the brush body 20 toward the second casing 12 to move back to its original position. Thereby, the multiple bristles 21 retract into the housing 10 automatically.

With reference to FIGS. 2 and 3, the mist spraying assembly 40 is disposed in the containing space 13 of the housing 10, and has an electric oscillation assembly 41 and a liquid tank 42. The oscillation assembly 41 is disposed in the containing space 13, is mounted in the mounting hole 112 of the housing 10, and has a nozzle 411 and an oscillation element 412. The nozzle 411 is mounted in the mounting hole 112, and the nozzle 411 has a spout being divergent toward an exterior of the housing 10. The oscillation element 412 is disposed in the nozzle 411 and is adjacent to the spout of the nozzle 411. When the oscillation element 412 oscillates at a frequency high enough, the oscillation element 412 makes the liquid atomize.

The liquid tank 42 is mounted to the second casing 12, is disposed in the containing space 13 of the housing 10, is disposed above the brush body 20, and has an injection portion 421 and a liquid-supplying hole 422. The injection portion 421 extends into the passing hole 22 of the brush body 20 and communicates with the nozzle 411 of the oscillation assembly 41, such that the liquid contained in the liquid tank 42 flows to the oscillation element 412 via the injection portion 421.

When the oscillation element 412 oscillates at a frequency high enough, the liquid flowing to the oscillation element 412 is atomized into spray and flows out of the housing 10 via the spout of the nozzle 411. In this way, the user can brush his/her hair and spray the liquid such as water, hair conditioner, and essential oil on his/her hair at the same time by holding the present invention with a single hand rather than holding a hair brush and a spray bottle with two hands respectively. The liquid-supplying hole 422 is disposed through the liquid tank 42, communicates with the injection portion 421, and is aligned with the injection hole 122 of the second casing 12. The user can inject the liquid into the liquid tank 42 via the injection hole 122 and the liquid-supplying hole 422. Moreover, the liquid-supplying hole 422 corresponds in contour to the plug 124, which prevents seepage of the liquid contained in the liquid tank 42 after the plug 124 is inserted into the injection hole 122.

With reference to FIGS. 1, 2, 3, and 6, the electric control unit 50 is disposed in the containing space 13 of the housing 10 and is electrically connected to the oscillation element 412 of the mist spraying assembly 40 to generate high frequency oscillation of the oscillation element 412. The electric control unit 50 has a circuit board 51, a charging port 52, a battery 53, and a button 54. The circuit board 51 is electrically connected to the oscillation element 412, the charging port 52, the battery 53, and the button 54. The charging port 52 is disposed on the circuit board 51, and the charging port 52 is aligned with the opening 123 of the second casing 12 as shown in FIG. 1. In the present invention, the charging port 52 is a universal serial bus (USB) port, and the user can connect a charging cable to the charging port 52 via the opening 123 to have the battery 53 charged. With reference to FIG. 3, the button 54 is received in the receiving hole 125 of the second casing 12, and oscillation of the oscillation element 412 can be controlled by pushing the button 54.

With the aforementioned technical characteristics of the present invention, the mist spraying hair brush with retractable bristles has the following advantages.

In use, the user only needs to press the button 54 once to keep the spray flowing out of the present invention rather than pressing the trigger 822 continuously to keep the liquid ejected from the multiple spouts 812 of the conventional water jet hair brush 80. Therefore the present invention is convenient in use and prevents muscle soreness of the user's hand.

The brush body 20, the actuating shaft 30, the mist spraying assembly 40, and the electric control unit 50 are all contained in the body 10, making the most of the containing space 13 of the housing 10. Therefore, the mist spraying hair brush with retractable bristles is small in size and is convenient in storage.

When the mist spraying hair brush with retractable bristles is not in use, the multiple bristles 21 retract into the housing 10. In this way, the multiple bristles 21 will not bend or break when carried in a bag full of objects.

Because the mist spraying assembly 40 is disposed in the housing 10, the mist spraying assembly 40 is electrically controlled, and the button 54 is well received in the receiving hole 125, the present invention can prevent the button 54 from being accidentally pressed by other objects carried in the bag. Thus, the present invention will not wet or stain the bag.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mist spraying hair brush with retractable bristles comprising:

a housing having a containing space defined in the housing;

a first casing having multiple through holes disposed through a side of the first casing, disposed at spaced intervals, and communicating with the containing space;

a second casing assembled with the first casing, and the containing space defined between the first casing and the second casing; and a mounting hole disposed through the side of the first casing that the multiple through holes are disposed through, spaced apart from and surrounded by the multiple through holes, and communicating with the containing space;

a brush body disposed in the containing space of the housing between the first casing and the second casing, moving linearly in the containing space, and having a base; and multiple bristles disposed at spaced intervals on a side surface of the base facing the first casing, and each one of the multiple bristles being capable of extending out of a corresponding one of the multiple through holes when the base moves toward the first casing;

at least one restoring spring mounted between the housing and the base of the brush body;

an actuating shaft being a single element, rotatably mounted to the housing, disposed in the containing space, and having a bended portion located between two ends of the actuating shaft and protruding radially; and a mist spraying assembly disposed in the containing space of the housing between the second casing and the actuating shaft, and having an oscillation assembly mounted in the mounting hole of the housing; and an injection portion disposed in the containing space of the housing, and communicating with the oscillation assembly, such that liquid flowing from the injection portion to the oscillation assembly is atomized into spray when the oscillation assembly is oscillating, and then the spray flows out of the housing via the mounting hole;

wherein when the actuating shaft is rotated and the bended portion pushes the base of the brush body, the brush body moves linearly and each one of the multiple bristles extends out of the corresponding through hole; and elastic potential energy is stored in the at least one restoring spring when the bended portion pushes the base of the brush body, and when the bended portion leaves the base, the elastic potential energy is released to make the at least one restoring spring bounce to make the multiple bristles retract into the housing.

2. The mist spraying hair brush with retractable bristles as claimed in claim 1, wherein the housing has an injection hole disposed through the second casing of the housing; and the mist spraying assembly has a liquid tank having a liquid-supplying hole communicating with the injection portion and aligned with the injection hole.

3. The mist spraying hair brush with retractable bristles as claimed in claim 2, wherein the housing has a plug detachably inserted into the injection hole and corresponding in contour to the injection hole and the liquid-supplying hole.

4. The mist spraying hair brush with retractable bristles as claimed in claim 3, wherein the mist spraying hair brush with retractable bristles has an electric control unit disposed in the containing space; and the oscillation assembly has a nozzle mounted in the mounting hole and having a spout; and an oscillation element disposed in the nozzle, adjacent to the spout of the nozzle, and electrically connected to the electric control unit.

5. The mist spraying hair brush with retractable bristles as claimed in claim 4, wherein the housing has an opening disposed through the second casing of the housing; and the electric control unit has a charging port aligned with the opening.

6. The mist spraying hair brush with retractable bristles as claimed in claim 4, wherein the housing has a receiving hole formed through the first casing of the housing; and the electric control unit has a button received in the receiving hole, and the oscillation element is controllable by pushing the button.

7. The mist spraying hair brush with retractable bristles as claimed in claim 2, wherein the mist spraying hair brush with retractable bristles has an electric control unit disposed in the containing space; and the oscillation assembly has a nozzle mounted in the mounting hole and having a spout; and an oscillation element disposed in the nozzle, adjacent to the spout of the nozzle, and electrically connected to the electric control unit.

8. The mist spraying hair brush with retractable bristles as claimed in claim 7, wherein the housing has an opening disposed through the second casing of the housing; and the electric control unit has a charging port aligned with the opening.

9. The mist spraying hair brush with retractable bristles as claimed in claim 7, wherein the housing has a receiving hole formed through the first casing of the housing; and the electric control unit has a button received in the receiving hole, and the oscillation element is controllable by pushing the button.

10. The mist spraying hair brush with retractable bristles as claimed in claim 1, wherein the mist spraying hair brush with retractable bristles has an electric control unit disposed in the containing space; and the oscillation assembly has a nozzle mounted in the mounting hole and having a spout; and an oscillation element disposed in the nozzle, adjacent to the spout of the nozzle, and electrically connected to the electric control unit.

11. The mist spraying hair brush with retractable bristles as claimed in claim 10, wherein the housing has an opening disposed through the second casing of the housing; and the electric control unit has a charging port aligned with the opening.

12. The mist spraying hair brush with retractable bristles as claimed in claim 10, wherein the housing has a receiving hole formed through the first casing of the housing; and the electric control unit has a button received in the receiving hole, and the oscillation element is controllable by pushing the button.

* * * * *